US006869073B2

(12) United States Patent
Horrocks

(10) Patent No.: US 6,869,073 B2
(45) Date of Patent: Mar. 22, 2005

(54) VERTICAL BOARD GAME AND APPARATUS THEREFOR

(76) Inventor: Jeffrey S. Horrocks, 1732 Hopewell Rd., Elverson, PA (US) 19520

( * ) Notice: Subject to any disclaimer, the term of this patent is extended or adjusted under 35 U.S.C. 154(b) by 0 days.

(21) Appl. No.: 10/764,719

(22) Filed: Jan. 26, 2004

(65) Prior Publication Data

US 2004/0155406 A1 Aug. 12, 2004

Related U.S. Application Data

(60) Provisional application No. 60/443,200, filed on Jan. 29, 2003.

(51) Int. Cl.[7] ..... A63F 3/00
(52) U.S. Cl. ..... 273/290; 273/280
(58) Field of Search ..... 273/280, 290; D21/336, 337; 446/69

(56) References Cited

U.S. PATENT DOCUMENTS

| | | | | |
|---|---|---|---|---|
| 3,655,201 | A | 4/1972 | Nichols | |
| 4,055,343 | A | 10/1977 | Stuart | |
| 4,227,696 | A | 10/1980 | Silverman | |
| 4,243,227 | A | 1/1981 | Strongin | |
| 4,687,207 | A | 8/1987 | Darling | |
| 5,100,150 | A | 3/1992 | Larman | |
| 5,221,085 | A | 6/1993 | Reed | |
| 5,251,085 | A | 10/1993 | Morris et al. | |
| 5,332,221 | A | 7/1994 | Reed | |
| 5,839,727 | A | 11/1998 | Stillinger | |
| 6,352,262 | B1 | 3/2002 | Looney | |
| 6,581,933 | B1 * | 6/2003 | Zivan | 273/241 |

* cited by examiner

*Primary Examiner*—Vishu K. Mendiratta
(74) *Attorney, Agent, or Firm*—Synnestvedt & Lechner LLP

(57) ABSTRACT

A game and an apparatus for playing the game are disclosed. The apparatus includes a plurality of bodies stacked vertically one above another. Each body is rotatable about a common axis of rotation, vertically oriented. Each body has a plurality of faces, each face has a slot forming a display window. The slots receive tokens. There are two types of tokens. Turning the bodies relative to one another aligns the slots and effects a transfer of tokens from a higher to a lower body. The game is played by two players in a sequence of alternating turns. The object of the game is to get a predetermined number of one type of token adjacent to one another, either on the same body, on adjacent bodies or in a helical pattern around the axis of rotation. Each player in their turn may either insert a token into a slot or spin a body about the axis of rotation to transfer a token.

17 Claims, 4 Drawing Sheets

22
10
38
24
38a
18
40
36
32
38b
16
40
14
30
30
32
34
2
12
20
34
2
32
36

FIG.4
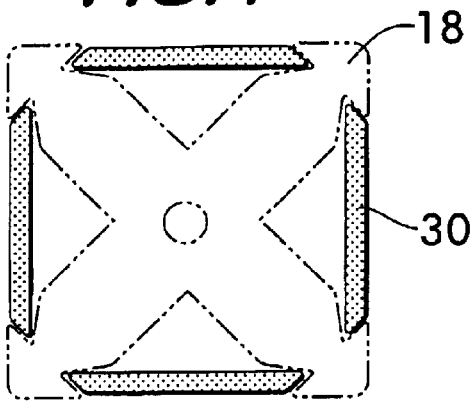
FIG.5
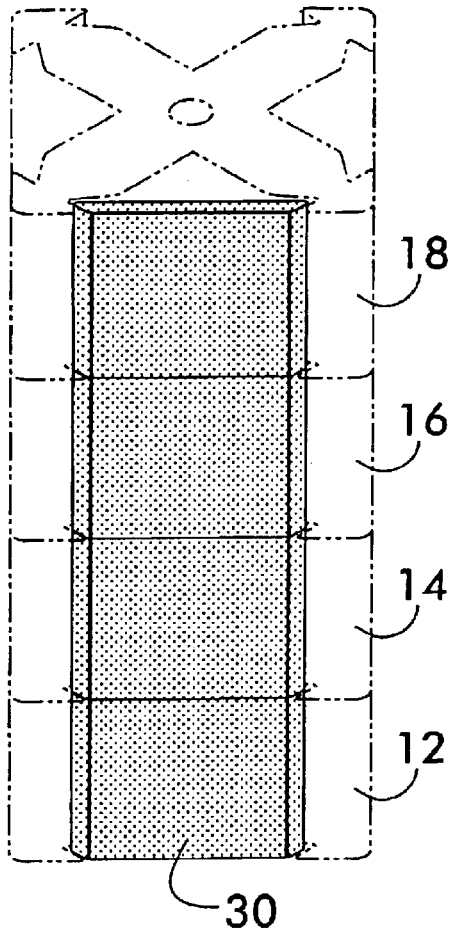
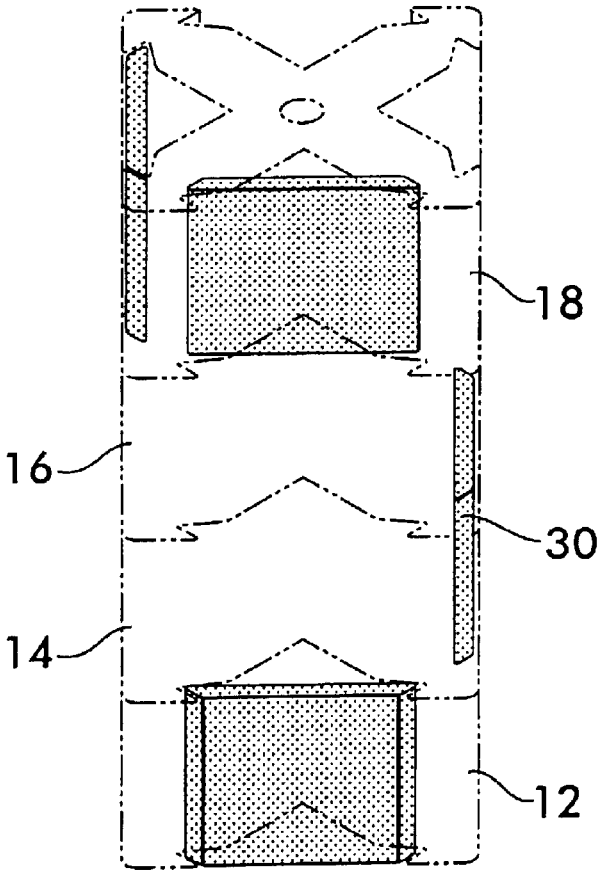
FIG.6

VERTICAL BOARD GAME AND APPARATUS THEREFOR

This application claims benefit of Provisional Ser. No. 60/443,200 filed Jan. 29, 2003.

FIELD OF THE INVENTION

This invention concerns a strategy game played for amusement and an apparatus and method for playing the game.

BACKGROUND OF THE INVENTION

Strategy games, often played for amusement, are useful for developing abilities such as abstract reasoning, improved memory, mental calculation, logic, and three-dimensional visualization. These skills are developed within a framework of constraints imposed by the rules of the particular game as well as by the apparatus used to play the game. It is desired that as many skills as possible be used in a game to provide an interesting and challenging experience for the players. It is, however, difficult to develop a game that is challenging and interesting but has rules that are easy to learn, and an apparatus that is easy to use. The strategy game described and claimed herein is such a game.

SUMMARY OF THE INVENTION

The invention concerns an apparatus for playing a game. The apparatus comprises a plurality of first tokens, each of the first tokens having a substantially similar first identifying characteristic. The characteristic may be a distinguishing color or particular indicia displayed on the tokens. A plurality of second tokens are also included. Each of the second tokens also has a substantially similar second identifying characteristic different from the first characteristic. A plurality of bodies are positioned adjacent to one another, preferably vertically stacked one atop the other. All of the bodies are rotatable relatively to one another about a common axis of rotation. The axis of rotation is preferably oriented substantially vertically.

Preferably, each of the bodies is relatively rotatable with respect to the others by provision of a receptacle positioned at one end and a projection positioned at an opposite end and extending outwardly therefrom. The receptacles and the projections are aligned with the axis of rotation. Each receptacle is sized to receive a projection extending from an adjacent one of the bodies. The projections engage the receptacles when the bodies are positioned adjacent to one another and facilitate rotation of the bodies relative to one another about the common axis of rotation.

Each of the bodies has a plurality of faces facing away from the axis of rotation. Each face has a slot defining a display window for slidably receiving and displaying one of the first and second tokens. The slots are alignable with one another upon rotation of the bodies. A token on one face of one body is transferable to another face on another body upon alignment of the slot in the one face with the slot in the other face.

Preferably, a base is positioned beneath the lower most one of the bodies. The base has a projection extending outwardly therefrom and aligned with the axis of rotation. The lowermost body has a receptacle positioned at one end thereof. The receptacle receives the projection. The receptacle and the projection facilitate rotation of the lowermost body relative to the base.

The invention also includes a method of playing a game using the above described apparatus. The method includes a sequence of alternating turns in which a first player inserts one of the first tokens in one of the slots or turns one of the bodies relative to another of the bodies to align the slots in the bodies and thereby effect a transfer of one token between the bodies. A second player inserts one of the second tokens in one of the slots or turns one of the bodies relative to another of the bodies to align the slots in the bodies and thereby effect a transfer of one of the tokens between the bodies. The game ends when a predetermined number of either of the first or second tokens are arranged adjacent to one another on one of the bodies or adjacent to one another on a plurality of the bodies or on the bodies in a helical pattern around the axis of rotation.

BRIEF DESCRIPTION OF THE DRAWINGS

FIGS. 4–6 are phantom views of the apparatus showing strategies for winning the game according to the invention.

DETAILED DESCRIPTION OF THE EMBODIMENTS

Figure 1:
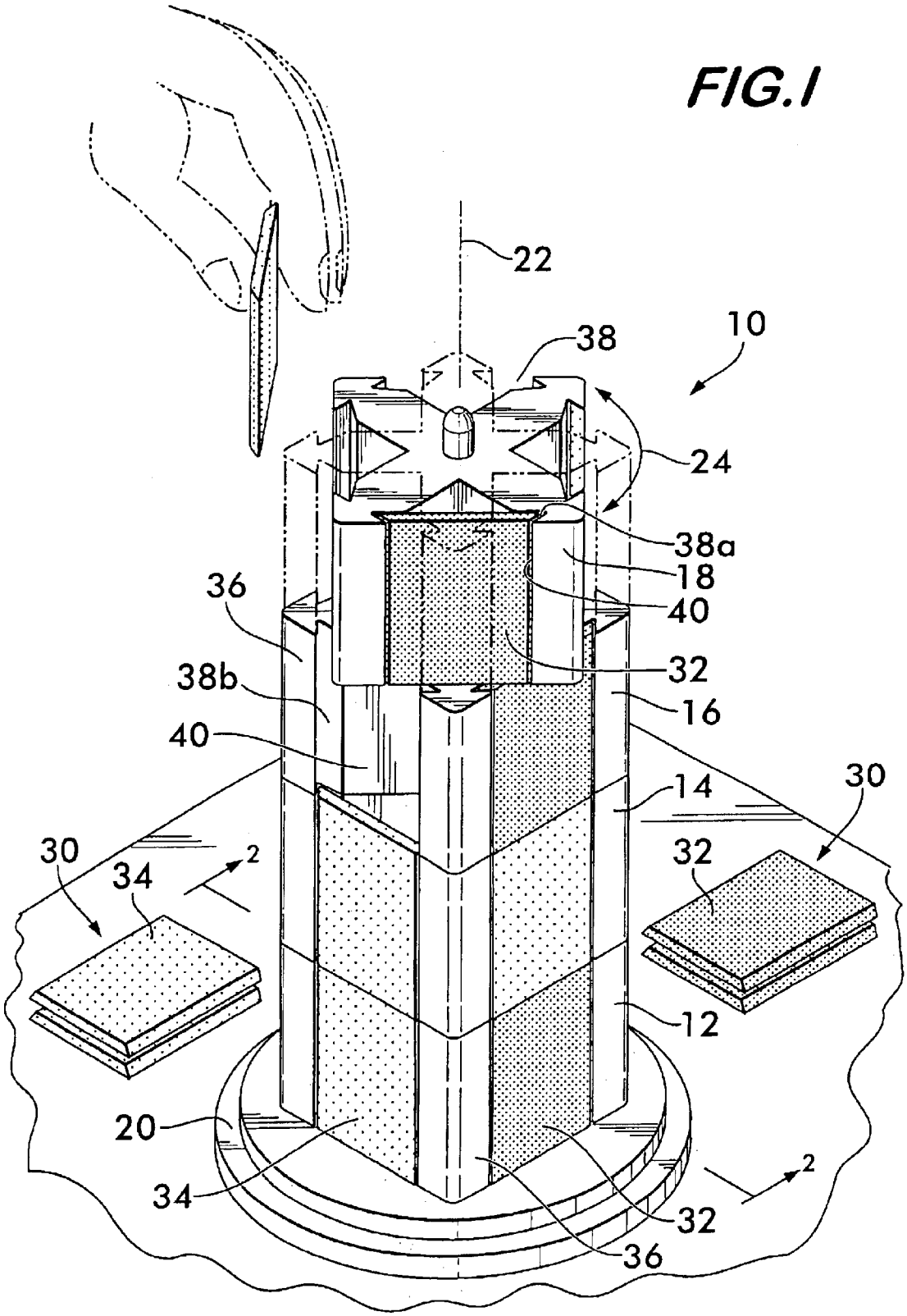
FIG. 1 is a perspective view of a game apparatus according to the invention.
Figure 2:
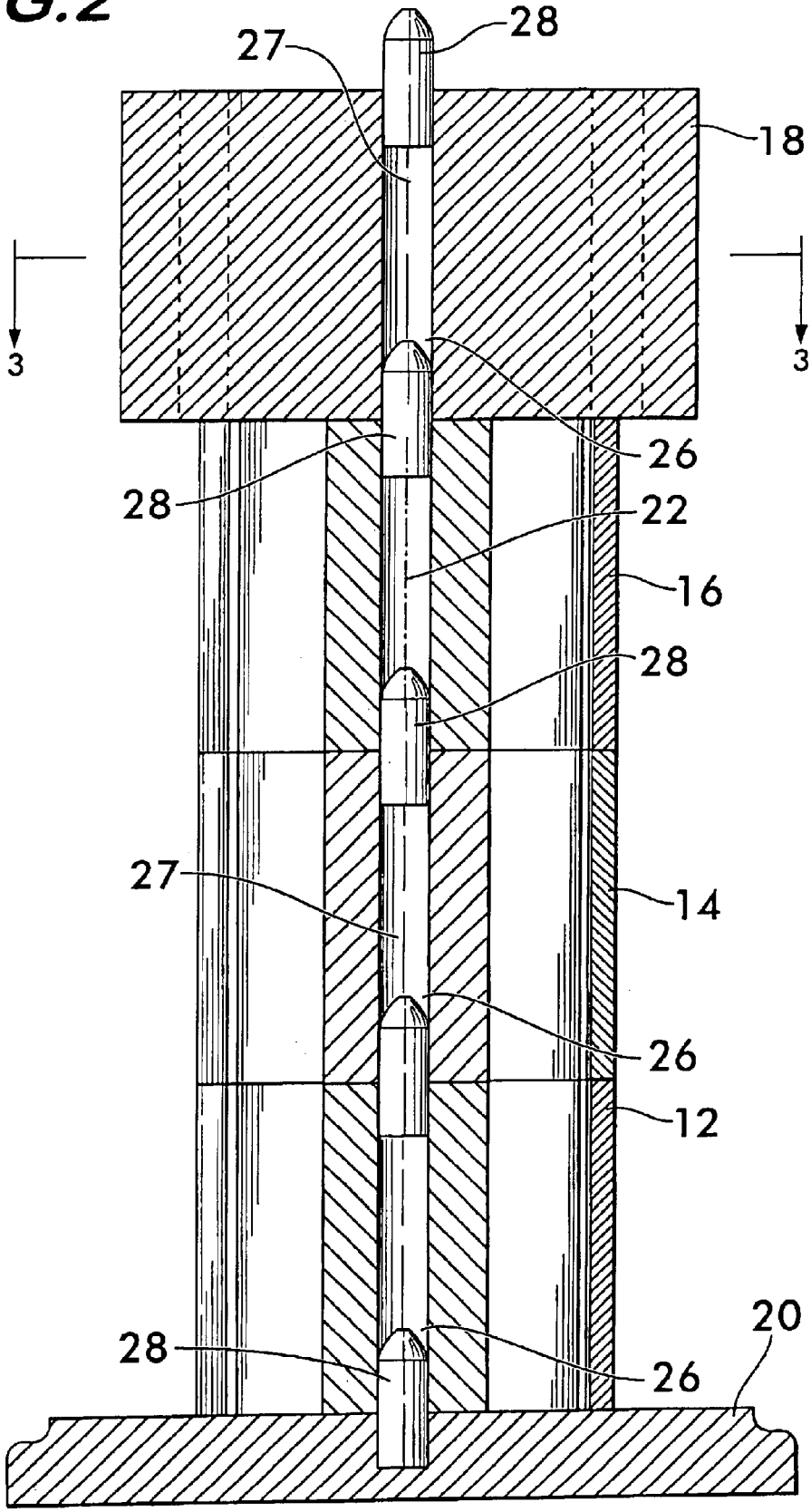
FIG. 2 is a longitudinal sectional view taken along line 2—2 of FIG. 1.

FIG. 1 is a perspective view of an apparatus 10 for playing a game according to the invention. Apparatus 10 comprises a plurality of bodies 12, 14, 16 and 18 preferably stacked one atop the other and supported on a base 20. The bodies are rotatable relative to one another about a common axis of rotation 22 as illustrated by the arrow 24. Preferably, the axis of rotation 22 is vertically oriented, consistent with the vertical arrangement of bodies 12, 14, 16 and 18. As best shown in FIG. 2, each body has a receptacle 26 at its lower end and a projection 28 extending outwardly from its upper end. Receptacle 26 may be conveniently formed by a drilled bore 27 extending entirely through the bodies 12, 14, 16 and 18. Bore 27 forms the receptacle 26 at the lower end of each body and provides an opening for mounting the projection 28 at the upper end. The projections 28 and receptacles 26 are co-axially aligned with the axis of rotation 22. The receptacles 26 are sized to receive the projections 28 and thereby facilitate rotation bodies 12, 14, 16 and 18 relative to one another. Base 20 has a projection 28 that engages the receptacle 26 in the lowermost body 12.

As shown in FIG. 1, the apparatus also includes a plurality of tokens 30. Tokens 30 are preferably rectangular and are divided into two groups, the tokens 32 of a first group (called "first tokens") and the tokens 34 of a second group (called "second tokens"). The first tokens 32 have substantially similar characteristics which identify them as being members of the first group. The second tokens 34 also have identifying characteristics that are substantially similar for all of the tokens of the second group but are different from the characteristics of first tokens 32. For example, first tokens 32 may have a first identifying indicia displayed thereon, and second tokens 34 may have a second identifying indicia displayed thereon. Alternately, first tokens 32 may have a first color displayed thereon, while second tokens 34 may have a second color displayed thereon. The distinguishing characteristics, regardless of their type, are represented by different shading in the Figures.

Figure 3:
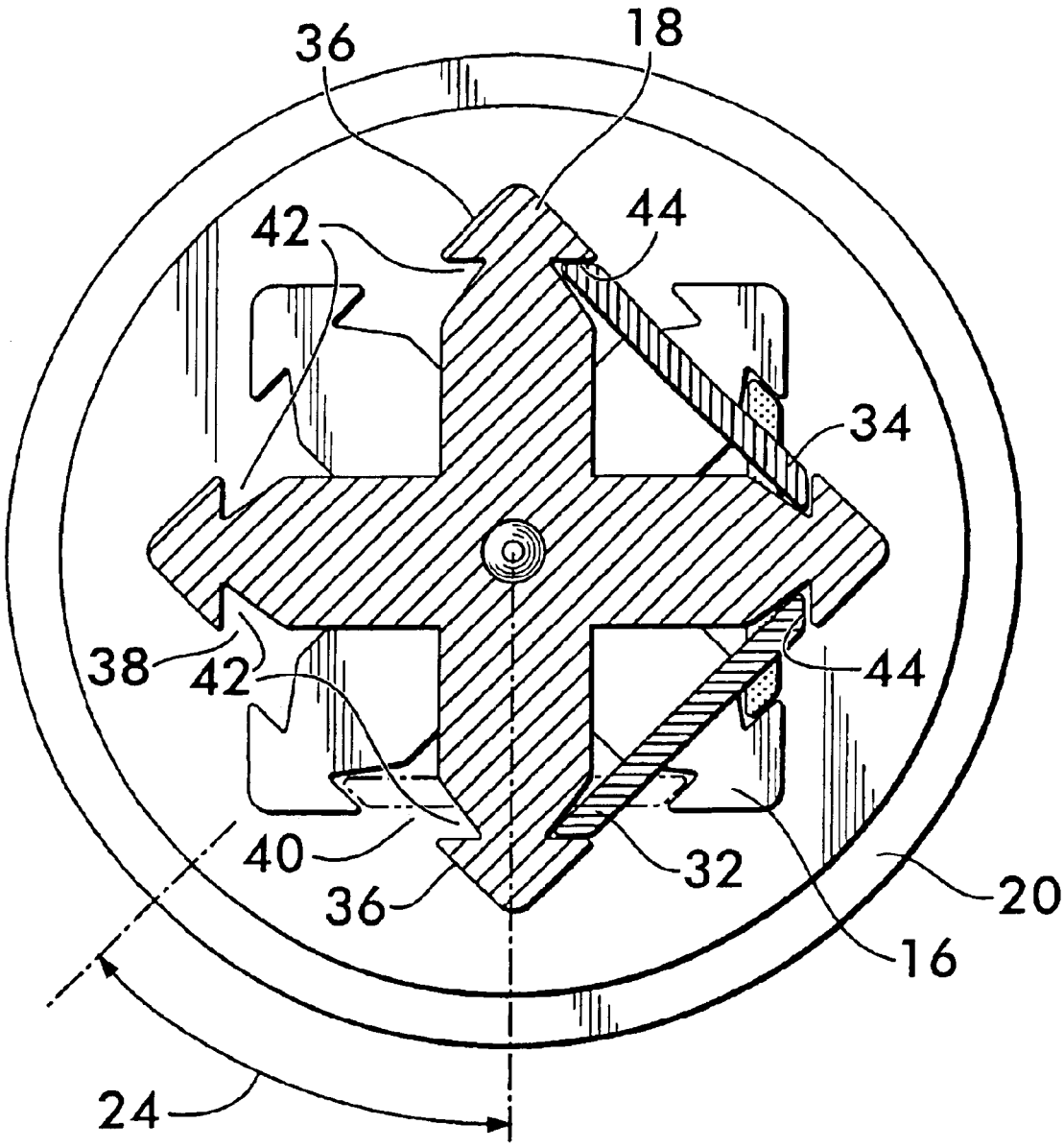
FIG. 3 is a cross-sectional view taken along line 3—3 of FIG. 2.

First and second tokens 32 and 34 are used in conjunction with bodies 12, 14, 16 and 18 to play the game according to the invention. Each body has a plurality of faces 36 that face outwardly from the axis of rotation 22. In the example shown, there are four bodies, 12, 14, 16 and 18, and four faces 36 on each body, each face 36 being angularly separated from an adjacent face by about 90°. However, there may be fewer or more bodies and fewer or more faces on each body depending upon the degree of complexity desired in the game. For the example having four bodies and four faces, there is preferably provided eight first and eight second tokens. Each face 36 has a slot 38 that defines a display window 40 for displaying one of either the first or second tokens 32 and 34. Preferably, as shown in FIG. 3, the slots 38 have dove-tail shaped cross sections 42 and the tokens 32 and 34 have opposed beveled edges 44 that are complementary to the dove-tail cross section 42 of the slots 38. This allows the tokens 32 and 34 to be slidably received within the slots 38 for display in the window 40 of each face 36. Other slot configurations are of course feasible.

Any slot 38 on any face 36 on a body may be aligned with any slot 38 on any face 36 on an adjacent body by rotating the adjacent bodies relatively to one another. This is best illustrated in FIG. 1, as body 18 is rotated relatively to body 16 to bring slot 38*a* (displaying token 32) in body 18 into alignment with slot 38*b* (empty) in body 16. Bringing slots 38 into alignment with one another allows the transfer of a token 30 from the face of one body to the face of the adjacent body provided the window 40 of the adjacent body is empty. In FIG. 1, rotation of body 18 brings slot 38*a* with a first token 32 in its window 40 into alignment with slot 38*b* in adjacent body 16. Upon alignment, gravity pulls first token 32 from slot 38*a* in body 18 into slot 38*b* in body 16. If the axis of rotation 22 of bodies 12, 14, 16 and 18 had a different orientation, horizontal for example, then the tokens 30 could simply be manually transferred.

In a preferred method of playing the game according to the invention, the object of the game, as illustrated in FIGS. 4–6, is to position a predetermined number of tokens 30 from the same group in one of the following arrangements:

(1) adjacent to one another on the same body (FIG. 4);

(2) adjacent to one another on different bodies (FIG. 5); or (3) in a helical pattern around the axis of rotation 22 (FIG. 6).

In the example shown, the predetermined number of tokens to be arranged in the winning pattern is four.

The game is played by two players in a sequence of alternating turns. A first player has the first tokens 32, a second player has the second tokens 34. In their respective turn, either player may do one of two things:

(1) insert a token into a slot on the uppermost body 18; or (2) turn one body relative to the other bodies.

A body may only be turned if there is an open slot into which a token may drop. Once the token drops, that player's turn is over. If a body below the top body is spun, all of the bodies above it must spin with it, i.e., if body 14 is spun, bodies 16 and 18 spin with it relative to body 12. Players may only view the set of faces that are in their direct line of sight. Thus, in the example shown, there will be three faces not visible to each player, requiring them to remember the configuration, calculate the effects of rotation of a body or insertion of a token and visualize the result of any action. Once a player succeeds in positioning tokens of the same group in one of the three arrangements set out above, that player wins and the game is over.

The game and apparatus according to the invention present a challenging contest for the players that helps develop skills of memory, calculation and three dimensional visualization within the context of simple rules and an easy to use apparatus.

What is claimed is:

1. An apparatus for playing a game, said apparatus comprising:

a plurality of first tokens, each of said first tokens having a substantially similar first identifying characteristic;

a plurality of second tokens, each of said second tokens having a substantially similar second identifying characteristic different from said first characteristic; and a plurality of bodies positioned adjacent to one another, all of said bodies being rotatable relatively to one another about a common axis of rotation, each of said bodies having a plurality of faces facing away from said axis of rotation, each said face having a through slot defining a display window for slidably receiving and displaying one of said first and second tokens, said through slots being alignable with one another upon rotation of said bodies, one of said tokens being slidably transferable from one of said faces on one of said bodies to another of said faces on another of said bodies upon alignment of said through slot in said one face with said through slot in said other face, said one token engaging both of said through slots simultaneously during transfer.

2. An apparatus according to claim 1, wherein said axis of rotation is oriented substantially vertically and said bodies are positioned one atop another.

3. An apparatus according to claim 2, further comprising a base positioned beneath a lower most one of said bodies, said base having a projection extending outwardly therefrom and aligned with said axis of rotation, said lowermost body having a receptacle positioned at one end thereof, said receptacle receiving said projection, said receptacle and said projection facilitating rotation of said lowermost body relative to said base.

4. An apparatus according to claim 2, wherein transfer of one of said tokens from one of said faces on one of said bodies to another of said faces on an adjacent body positioned below said one body occurs by gravity upon alignment of said slot on said one face with said slot on said other face.

5. An apparatus according to claim 1, wherein each of said bodies has a receptacle positioned at one end and a projection positioned at an opposite end and extending outwardly therefrom, said receptacle and said projection being aligned with said axis of rotation, said receptacle in each said body being sized to receive a projection extending from an adjacent one of said bodies, said projections engaging said receptacles when said bodies are positioned adjacent to one another and facilitating rotation of said bodies relative to one another about said common axis of rotation.

6. An apparatus according to claim 1, wherein said slots have a dove-tail shaped cross section and said tokens have opposed beveled edges, said edges being complementary to the dove-tail shaped cross section so as to be slidably retained within said slots.

7. An apparatus according to claim 1, wherein said tokens are rectangular in shape.

8. An apparatus according to claim 1, comprising four of said bodies.

9. An apparatus according to claim 8, wherein each of said bodies comprises four of said faces, said faces being positioned in angularly spaced apart relation around said bodies.

10. An apparatus according to claim 9, wherein said angular spacing between adjacent ones of said faces is about 90°.

11. An apparatus according to claim 10, comprising eight of said first tokens and eight of said second tokens.

12. An apparatus according to claim 1, wherein said identifying characteristic comprises indicia displayed on said tokens.

13. An apparatus according to claim 1, wherein said identifying characteristic comprises a color displayed on said tokens.

14. A method of playing a game, said method comprising the steps of:

providing a plurality of first tokens, each of said first tokens having a substantially similar first identifying characteristic;

providing a plurality of second tokens, each of said second tokens having a substantially similar second identifying characteristic different from said first characteristic;

providing a plurality of bodies positioned adjacent to one another, all of said bodies being rotatable relatively to one another about a common axis of rotation, each of said bodies having a plurality of faces facing away from said axis of rotation, each said face having a through slot defining a display window for slidably receiving and displaying one of said first and second tokens, said through slots being alignable with one another upon rotation of said bodies, one of said tokens being slidably transferable from one of said faces on one of said bodies to another of said faces on another of said bodies upon alignment of said slot in said one face with said slot in said other face; and in a sequence of alternating turns, a first player inserting one of said first tokens in one of said through slots or turning one of said bodies relative to another of said bodies to align said slots in said bodies and thereby effect a transfer of one of said tokens between said bodies, and a second player inserting one of said second tokens in one of said slots or turning one of said bodies relative to another of said bodies to align said slots in said bodies and thereby effect a transfer of one of said tokens between said bodies, during either said transfer, said token engaging two of said through slots substantially simultaneously.

15. A method according to claim 14, wherein said bodies are provided one atop another.

16. A method according to claim 15, wherein turning said bodies is permitted only when one of said tokens, received in one of said slots on one of said bodies, will drop into another of said slots on another of said bodies positioned below said one body upon turning of said one body to align said one slot thereon with said other slot on said other body.

17. A method according to claim 14, further comprising the step of ending said game when a predetermined number of either of said first or second tokens are arranged adjacent to one another on one of said bodies, or adjacent to one another on a plurality of said bodies, or on said bodies in a helical pattern around said axis of rotation.

* * * * *